US006370922B1

(12) United States Patent
Brach et al.

(10) Patent No.: US 6,370,922 B1
(45) Date of Patent: Apr. 16, 2002

(54) ADJUSTABLE PLATING YARN CARRIER ASSEMBLY FOR KNITTING PLATED FABRIC

(75) Inventors: Ernesto Brach, Brooklyn, NY (US); Joshua Benin, Newark, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/786,674

(22) PCT Filed: Sep. 13, 1999

(86) PCT No.: PCT/US99/20940

§ 371 Date: Mar. 7, 2001

§ 102(e) Date: Mar. 7, 2001

(87) PCT Pub. No.: WO00/15890

PCT Pub. Date: Mar. 23, 2000

Related U.S. Application Data

(60) Provisional application No. 60/100,174, filed on Sep. 14, 1998, and provisional application No. 60/138,717, filed on Jun. 11, 1999.

(51) Int. Cl.[7] ..... D04B 15/54

(52) U.S. Cl. ..... 66/136

(58) Field of Search ..... 66/125 R, 126 R, 66/126 A, 133, 136, 137, 125 B

(56) References Cited

U.S. PATENT DOCUMENTS

| | | | | | |
|---|---|---|---|---|---|
| 2,789,422 | A | * | 4/1957 | Milla | 66/125 |
| 3,157,035 | A | * | 11/1964 | Boutillette | 66/125 |
| 3,826,110 | A | * | 7/1974 | Holder | 66/125 |
| 4,361,292 | A | | 11/1982 | Fecker et al. | |

FOREIGN PATENT DOCUMENTS

| | | | | |
|---|---|---|---|---|
| DE | 2127519 | | 6/1970 | |
| DE | 2127519 | * | 12/1971 | 66/125 |
| DE | 3641182 | | 12/1986 | |
| DE | 3641182 | * | 2/1988 | 66/125 |
| FR | 636019 | | 1/1927 | |
| FR | 636019 | * | 3/1928 | 66/125 |
| GB | 2033931 | | 11/1978 | |
| GB | 2033931 | * | 5/1980 | 66/125 |

* cited by examiner

*Primary Examiner*—Danny Worrell
(74) *Attorney, Agent, or Firm*—George M. Medwick

(57) ABSTRACT

An adjustable plating yarn carrier (1) having two yarn guides (32, 34) allowing for the adjustment of the angle between two yarns (H, S) and the angles of both yarns to the needle (N), for the knitting of plated fabric, is provided.

33 Claims, 8 Drawing Sheets

FIG. 1
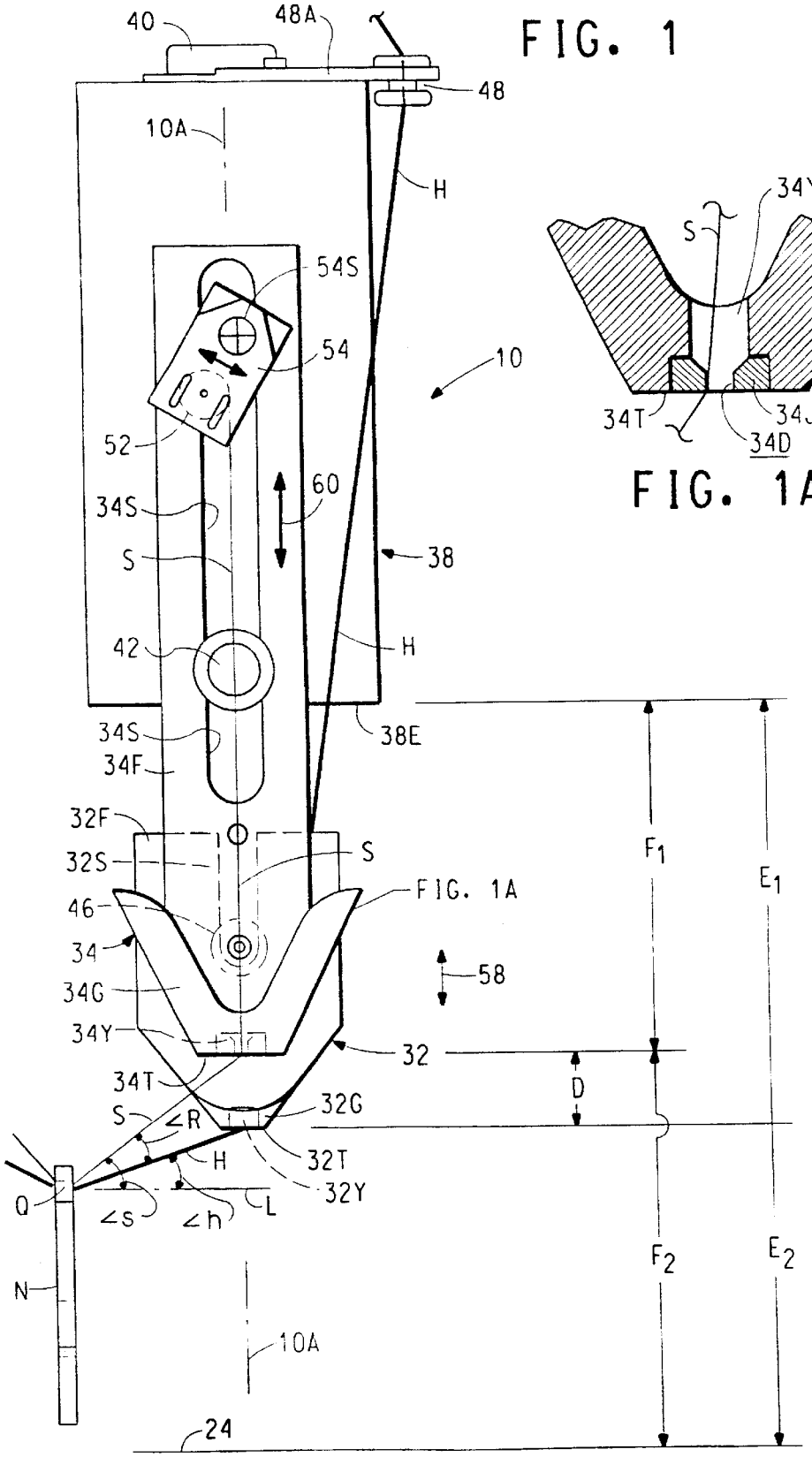
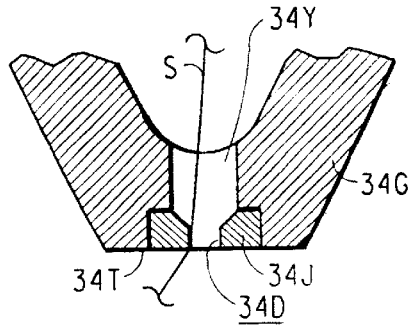
FIG. 1A

ADJUSTABLE PLATING YARN CARRIER ASSEMBLY FOR KNITTING PLATED FABRIC

This application claim benefit to Provisional 60/100,174 filed Sep. 14, 1998 which, claim benefit to Provisional Ser. No. 60/138,717 filed Jun. 11, 1999.

BACKGROUND OF THE INVENTION

This invention relates to a yarn carrier for a flat knitting apparatus for knitting plated fabrics.

DESCRIPTION OF THE PRIOR ART

"Plating" means the feeding of two yarns simultaneously to the needles of a knitting apparatus in such a way that there are two loops in each stitch, one from each yarn. These loops are positioned so that one loop is on one side of the stitch and the other loop is on the other side. The yarns may be either contrasting in color or having different fibrous compositions. For example, it is not unusual to plate a so-called "hard" yarn (such as nylon) with an elastomeric, or "soft" yarn. A suitable "soft" yarn is the elastomeric yarn manufactured and sold by E. I. du Pont de Nemours and Company under the registered trademark Lycra®.

In a plain stitch, there is thus either one color or one type of fibrous composition uppermost on one side, and the other color or fibrous composition uppermost on the other side. In rib fabric, where both face and reverse loops occur in the same course, both colors or fibrous compositions will appear on both sides of the fabric; face loops showing one color or one fibrous composition and reverse loops showing the other color or fibrous composition uppermost.

The plated effect is obtained by ensuring that the two plating yarns are fed to the needles at an angle, typically in the range from between fifteen to forty-five degrees (15° and 45°), measured from the point on the inside surface of the needle where the two yarns meet. This angle can depend on several factors, including the type of yarns being plated, stitch fabric construction, machine gauge, needle hook size or shape and stitch density. This angle can also be potentially important to ensure that the plated yarn (usually the elastomeric yarn) is positioned in such a manner that it not miss the point of the needle hook when it is supposed to be captured by the needle. This is especially important during the knitting of the first course of a sweater knit fabric at which time there is no yarn on the needle shank to close the needle latch and thereby trap the elastomeric yarn. The smaller the angle, the better the likelihood or capture of the plated yarn by the needle.

One means to achieve this is to delay the downward motion (the yarn capturing step) of the needle. This can be done by modifying the needle guard and the stitch cam, by increasing the width of the guard cam.

SUMMARY OF THE INVENTION

The present invention is directed toward a carrier for conveying a first and a second yarn to a needle with an angle being defined between the yarns and to a knitting apparatus including such a carrier.

The carrier comprises a first guide member and a second guide member. Each guide member has a tip through which a yarn dispensing passage extends. The passage defines yarn deflecting surfaces on each guide. Yarns emanating from yarn exit points at the ends of each of the yarn passages are guided toward a needle.

The first guide member and the second guide member are relatively movable with respect to each other in a first direction to adjust the spacing between the ends of the passages and thereby to adjust the angle between the yarns. One of the first guide member and the second guide members is also relatively movable with respect to the other in a second direction, thereby to adjust the relative position on the needle occupied by the first and second yarns. In one particular instance the first direction is generally parallel to a longitudinal reference axis extending through the carrier, while the second direction is generally transverse to the longitudinal reference axis.

BRIEF DESCRIPTION OF THE DRAWINGS

The invention will be more fully understood from the following detailed description taken in connection with the accompanying drawings, which form a part of this application, and in which:

FIGS. 1 and 2 are, respectively, front and side elevational views of a yarn carrier for a knitting apparatus in accordance with a first embodiment of this invention, with a portion of FIG. 2 being shown partially in section, while FIG. 1A is an enlarged front sectional view of a portion of a yarn guide of the carrier of FIG. 1;

DETAILED DESCRIPTION OF THE INVENTION

Figure 2:
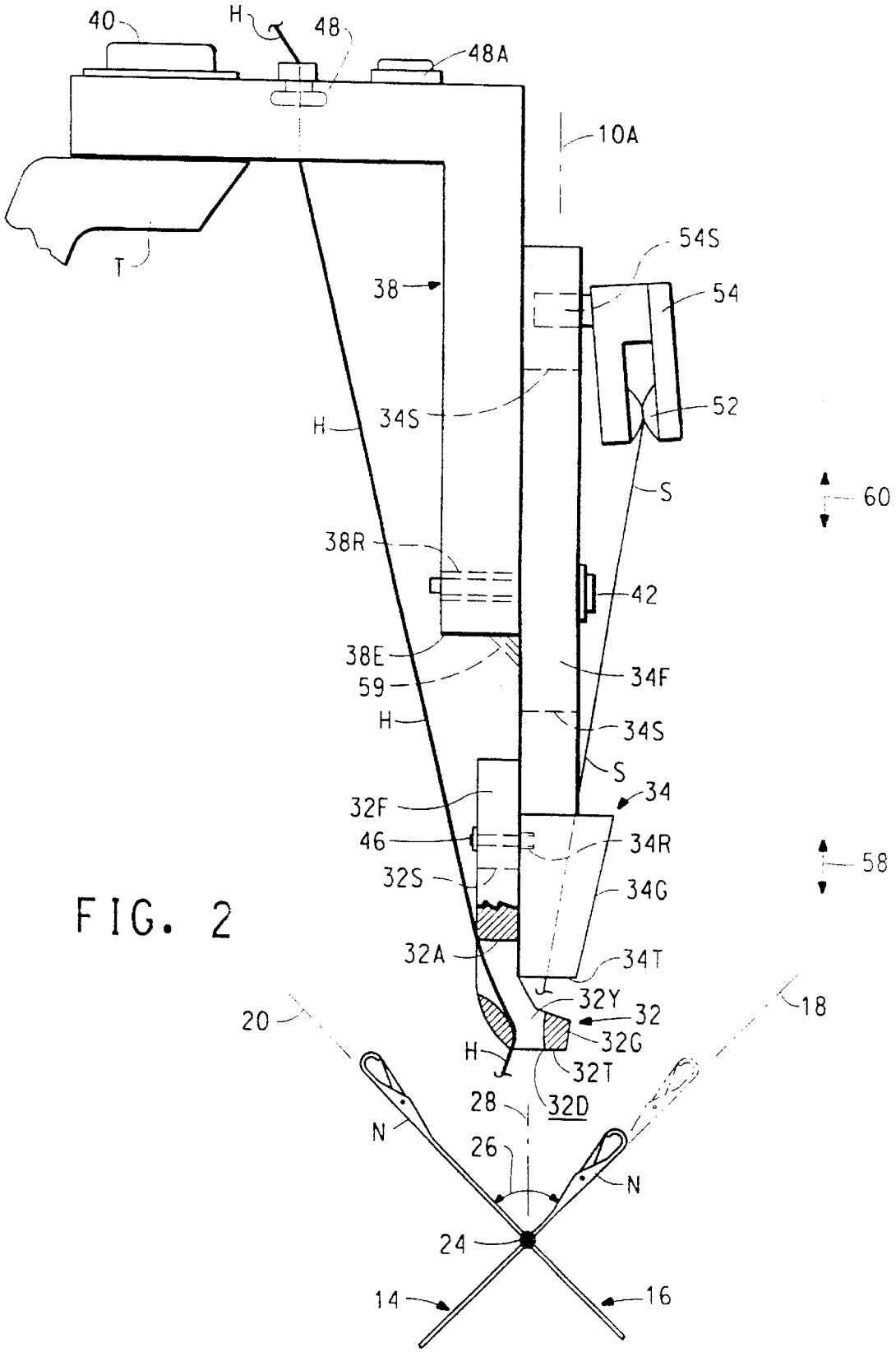

Throughout the following detailed description similar reference characters refer to similar elements in all figures of the drawings.

FIGS. 1 and 2 are, respectively, a front and a side elevational view of a yarn carrier generally indicated by the reference character 10 in accordance with a first embodiment of the present invention. The yarn carrier 10 is used to guide yarns to the needles of a flat knitting apparatus. Various portions of a typical knitting apparatus are stylistically illustrated in the figures to enable a more clear understanding of the structure of the carrier 10 and the relationship of the structure and movements of portions of the carrier 10 with respect to the knitting apparatus.

A typical flat knitting apparatus includes a plurality of knitting needles N. As seen in FIG. 2 the knitting needles N are typically arranged in front and rear needle arrays generally indicated by reference characters 14, 16 respectively. Each knitting needle N in the front needle array 14 is individually extendable and retractable in a first plane 18, while each needle in the rear needle array 16 is extendable and retractable in a second plane 20. As any given needle extends and retracts in its respective plane, it captures the plating yarns that are presented to it. The first and the second planes 18, 20 intersect to define a intersection line 24 (FIG. 2) that extends transversely across the knitting apparatus.

The front and rear planes 18, 20 define a angle 26 therebetween. It is convenient for definitional purposes to define within the apparatus a predetermined reference plane. Perhaps the most convenient plane to utilize as the reference plane is that plane 28 which bisects the angle 26 between the needle planes 18, 20 and that includes the transversely extending intersection line 24. The reference plane 28 is visible as a line in the plane of FIG. 2.

The yarn carrier 10 includes a first yarn guide member 32 and a second guide member 34. Each yarn guide member 32, 34 includes a generally cup-shaped guiding portion 32G, 34G with an integral mounting flange portion 32F, 34F respectively. The flange portions 32F, 34F each have an elongated slot 32S, 34S formed therein for a purpose to be described. The guiding portion 32G, 34G of each yarn guide member 32, 34 terminates in a respective tip 32T, 34T. The tip of the guide member 34 has a low friction jewel 34J, such as a sapphire, set therein. A yarn passage 32Y (FIG. 2) , 34Y (FIG. 1A), extends through the tip 32T, 34T of each respective yarn guide member 32, 34. The regions of the yarn passages 32, 34 in the vicinity of the intersection of the surface of each tip 32T, 34T and its corresponding yarn passage 32Y, 34Y defines a generally circular or oval yarn deflecting surface 32D (FIG. 2), 34D (FIG. 1A), respectively. Each yarn deflecting surface 32D, 34D deflects a yarn passing through the given yarn passage 32Y, 34Y toward the needle N.

A mounting bracket generally indicated by the reference character 38 carries both the first and second yarn guide members 32, 34. In the embodiment of FIGS. 1 and 2 the bracket 38 takes the form of a generally L-shaped member that is connected at one end by a screw 40 to a traversing mechanism T of the knitting apparatus of which the yarn carrier 10 forms a part.

It should be noted in the embodiment of the invention shown in FIGS. 1 and 2 that the flange portion 34F of the second guide member 34 is directly mounted to the second end of the bracket 38, while the first yarn guide member 32 is directly mounted to the second guide member 34. Any convenient attachment may be used. For example, the guide member 34 may held to the bracket 38 by a wide-head screw 42 that extends through the slot 34S in the flange 34F. When the screw 42 is threaded into a recess 38R in the bracket 38 the underside of the bolt 42 frictionally engages the second guide member 34 against the bracket 38.

A similar arrangement may be used to secure the first and second guide members 32, 34. A screw 46 (FIG. 2) extends through the slot 32S in the flange portion 32F of the first guide member 32 into threaded engagement with a recess 34R in the second guide member 34. The underside of the head of the bolt 46 frictionally engages the first guide member 32 against the second guide member 34.

A first plating yarn, such as a "hard" yarn "H", is supplied to the first yarn guide 32 through a porcelain grommet 48. The hard yarn H is illustrated in the drawings as a relatively heavy line. The grommet 48 is supported by an arm 48A. The arm 48A is pivotally adjustable with respect to the bracket 38 during set-up of the carrier 10. The arm 48A usually stays fixed while the carrier 10 is in use. The first yarn H is directed by the grommet 48 toward an access opening 32A (FIG. 2) located on the rear surface of the first yarn guide 32. The yarn H passes from the guiding portion 32G of the yarn guide 32 through the passage 32Y in the tip 32T thereof. The yarn H deflects against a contact point on the deflecting surface 32D as the yarn H leaves the first yarn guide 32 toward the needle N. As the carrier 10 is traversed across the knitting apparatus the hard yarn H deflects against different contact points on the deflecting surface 32D.

A second plating yarn, such as an elastomeric or "soft" yarn "S", is supplied to the second yarn guide 34 over a pulley 52. The soft yarn S is illustrated in the drawings as a relatively thin line. The pulley 52 rides on a jeweled bearing (not visible) carried in a housing 54. The housing 54 is itself pivotally mounted to the second guide member 34 though a screw 54S. The second yarn S is directed by the pulley 52 toward the guiding portion 34G of the yarn guide 34. As the soft yarn S exits the passage 34Y in the tip of the second yarn guide 34 it is deflected against a contact point on the deflecting surface 34D of the jewel 34J toward the needle N. Similar to the situation with the guide 32, as the carrier 10 is traversed across the knitting apparatus the soft yarn S deflects against different contact points on the deflecting surface 34D toward the needle N. The low friction jewel 34J is provided to minimize frictional forces as the soft yarn S passes from the passage 34Y in the yarn carrier 34 toward the needle N, as discussed in U.S. Pat. No. 5,931,023, issued Aug. 3, 1999 in the name of Ernesto Brach and assigned to the assignee of the present invention.

As seen in FIGS. 1 and 2 the points, or locations, on the deflecting surfaces 32D, 34D at which the respective yarns H, S exit from the ends of the passages 32Y, 34Y in the respective tips 32T, 34T of the yarn guides 32, 34 are illustrated as being spaced a distance D from each other. The distance D between the yarn exit points at the ends of the passages 32Y, 34Y in the tips 32T, 34T can be measured with respect to any desired reference datum. A convenient reference datum is a reference axis 10A that extends longitudinally through the joined yarn guide members 32, 34. By the term "longitudinally" it is meant that the axis 10A extends generally parallel to the long direction of the carrier 10. The long direction may be considered the general direction in which the yarns H, S pass through the yarn guides 32, 34, or the direction of the carrier 10 as it moves toward and away from the intersection line 24. The axis 10A is preferably defined to lie perpendicular to the intersection line 24. The defined axis 10A may, but need not, lie in the reference plane 28.

The yarn exit point at the end of the passage 32Y in the tip 32T of the first yarn guide 32 lies a first distance $E_1$ from the lower edge 38E of the bracket 38, and a second distance $E_2$ from the intersection line 24. The yarn exit point at the end of the passage 32Y in the tip 34T on the second yarn guide 34 is spaced a first distance $F_1$ from the lower edge 38E of the bracket 38, and lies a second distance $F_2$ from the intersection line 24. The distances $E_1$, $E_2$, $F_1$, and $F_2$ are all conveniently measured along the reference axis 10A.

As noted earlier, successfully plating a hard yarn H with a soft yarn S requires that the two plating yarns H, S exhibit a desired angular relationship with respect to each other. Only yarns that are appropriately oriented in space will be properly collected by the knitting needle N and will occupy the desired relative positions on the hook of the needle necessary for successful plating. As seen in the FIG. 1 the yarns H, S should define a predetermined angle $\angle R$ with respect to each other. Typically the angle $\angle R$ lies in the range from between fifteen and forty-five degrees (15° and 45°). As a corollary, the yarns H and S each also define an angle $\angle h$, $\angle s$, each as respectively measured from a suitable reference datum, such as a line indicated in the Figures by the reference character L that originates at the point Q on the inside surface of the needle N where the yarns H, S meet the needle N and which extends parallel to the intersection line 24.

However, as a practical matter, in the knitting operation variations can occur, owing either to the yarns, fabric constructions, machine gauges, needle hook size or shape or stitch density. Any of these variations can change the value of the angle ∠R that is needed for producing properly plated fabric. The yarn carrier 10 in accordance with this invention is structured to permit the yarn guides 32, 34 to be relatively movable with respect to each other and to other features of the carrier. As will be developed, these relative movements impart to the carrier 10 the ability to adjust selectably the angles ∠h, ∠s respectively defined between each of the yarns H, S and the line L passing through the point Q on the needle N, as well as the relative angle ∠R defined with respect to each other.

From inspection of FIG. 1 it may be observed that the angle ∠R between the yarns H, S may be adjusted in a variety of ways. Most directly, the angle ∠R may be modified by adjusting the distance D between the respective tips 32T, 34T of the yarn guides 32, 34. Alternatively, if the distance D is held constant, the angle ∠R may be adjusted by either:

(1) adjusting the angle ∠h between the hard yarn H and the reference datum L; and/or (2) adjusting the angle ∠s between the soft yarn S and the reference datum L.

The structure of the carrier 10 of the present invention is capable of achieving each of these adjustments.

The first guide member 32 and the second guide member 34 are relatively movable with respect to each other. To adjust the distance D between the yarn exit points at the ends of the passages 32Y, 34Y in the respective tips 32T, 34T of the yarn guides 32, 34, the screw 46 is loosened, and the first yarn guide member 32 is moved in the directions indicated by the arrow 58. The direction of relative motion 58 between the yarn guides 32, 34 is generally parallel to the axis 10A. Relatively moving the yarn guides 32, 34 with respect to each other either increases or decreases the distance D, dependent upon the direction of motion. Relative movement between the yarn guides 32, 34 downwardly or upwardly (in the directions of the arrow 58) has the result of either respectively increasing or decreasing (as measured against the axis 10A) the angle ∠R between the yarns H, S. It should be noted that although the relative motion of the yarn guides is illustrated as rectilinear motion, it need not be so limited. The guides 32, 34 can displace rotationally, helically, pivotally or along any desired path, so long as the motion results in the distance D between the yarn exit point at the ends of the passages 32Y, 34Y in the tips 32T, 34T and the relative angle ∠R between the yarns H, S being decreased or increased.

Although in the embodiment illustrated in FIGS. 1 and 2 the guide member 34 is relatively movable with respect to the bracket 38, it should be appreciated that such a relationship is not necessary in order to change the distance D. So long as the yarn guides 32, 34 are relatively movable with respect to each other, it is not required that that one of the yarn guides be relatively movable with respect to the bracket. Thus, if desired, the adjustable connection provided by the releasable screw 42 between the guide 34 and the bracket 38 could be omitted, and the guide 34 securely fixed to the bracket 38. This fixed connection between these members is indicated schematically by the connection 59 (FIG. 2).

The ability to move the guide member 34 with respect to the bracket 38 facilitates the adjustment of the angle ∠h and between the hard yarn H and the reference datum (the line L). Relative movement of the member 34 with respect to the bracket 38 in a direction of the arrow 60 (generally parallel to the reference axis 10A) directly serves to adjust the distance $F_1$ between the yarn exit point at the end of the passage 34Y in the tip 34T on the guide member 34 and the bracket 38 and the distance $F_2$ between the yarn exit point at the end of the passage 34Y in the tip 34T and the intersection line 24. As a result of the relative movement between the guide 34 and the bracket 38 the angle ∠s and between the soft yarn S and the line L is directly varied.

It should be noted that since the first guide member 32 is mounted to the second guide member 34, movement of the guide 34 carries with it the guide 32. Thus, movement of the guide member 34 with respect to the bracket 38 to change the angle ∠s also has the secondary effects of changing the distance $E_1$ (between the bracket 38 and the yarn exit point at the end of the passage 32Y in the tip 32T on the guide member 32) and the distance $E_2$ (between the yarn exit point at the end of the passage 32Y in the tip 32T and the intersection line 24), and varying the angle ∠h between the hard yarn H and the line L. It is noted that since the guide member 32 is also movably mounted to the member 34, any necessary compensating adjustments may be made by adjusting the member 32 with respect to the member 34.

It should be readily appreciated that the connection of the members can be reversed. That is to say, the first guide member 32 may be the one guide member that is movably mounted to the bracket, with the second guide member 34 being either fixedly or movably mounted to the first member 32. This alternative construction would facilitate the direct adjustment of the distances $E_1$, $E_2$ and the angle ∠h, with the adjustment of the distances $F_1$, $F_2$ and the angle ∠s being a secondary effect. The embodiment of FIGS. 3–7 illustrate such an alternative construction in which the first guide member 32 is directly connected to the bracket 38.

Summarizing, it is appreciated from the foregoing that the yarn carrier 10 of the present invention in which the yarn guides 32, 34 are movable with respect to each other and with respect to the bracket 38 enables adjustment of the angle ∠R between the hard yarn H and the soft yarn S, as well as adjustment of the angles ∠h, ∠s between the hard yarn H and the soft yarn S in relation to the line L through the needle N.

-o-0-o-

FIGS. 3 through 7 illustrate a second embodiment the yarn carrier 10' in accordance with the present invention. Structural elements and relationships corresponding to those discussed in connection with FIGS. 1 and 2 are indicated by primed reference characters. As should become clearer the embodiment of the invention shown in FIGS. 3 through 7 is believed to provide a more robust structure over that shown in FIGS. 1 and 2. In addition, the embodiment of the invention shown in FIGS. 3 through 7 provides another degree of freedom of relative motion between the yarn guides 32', 34' that permits yet a further refinement for adjusting the angles of feeding the yarns to knitting needle (s) N.

Figure 3:
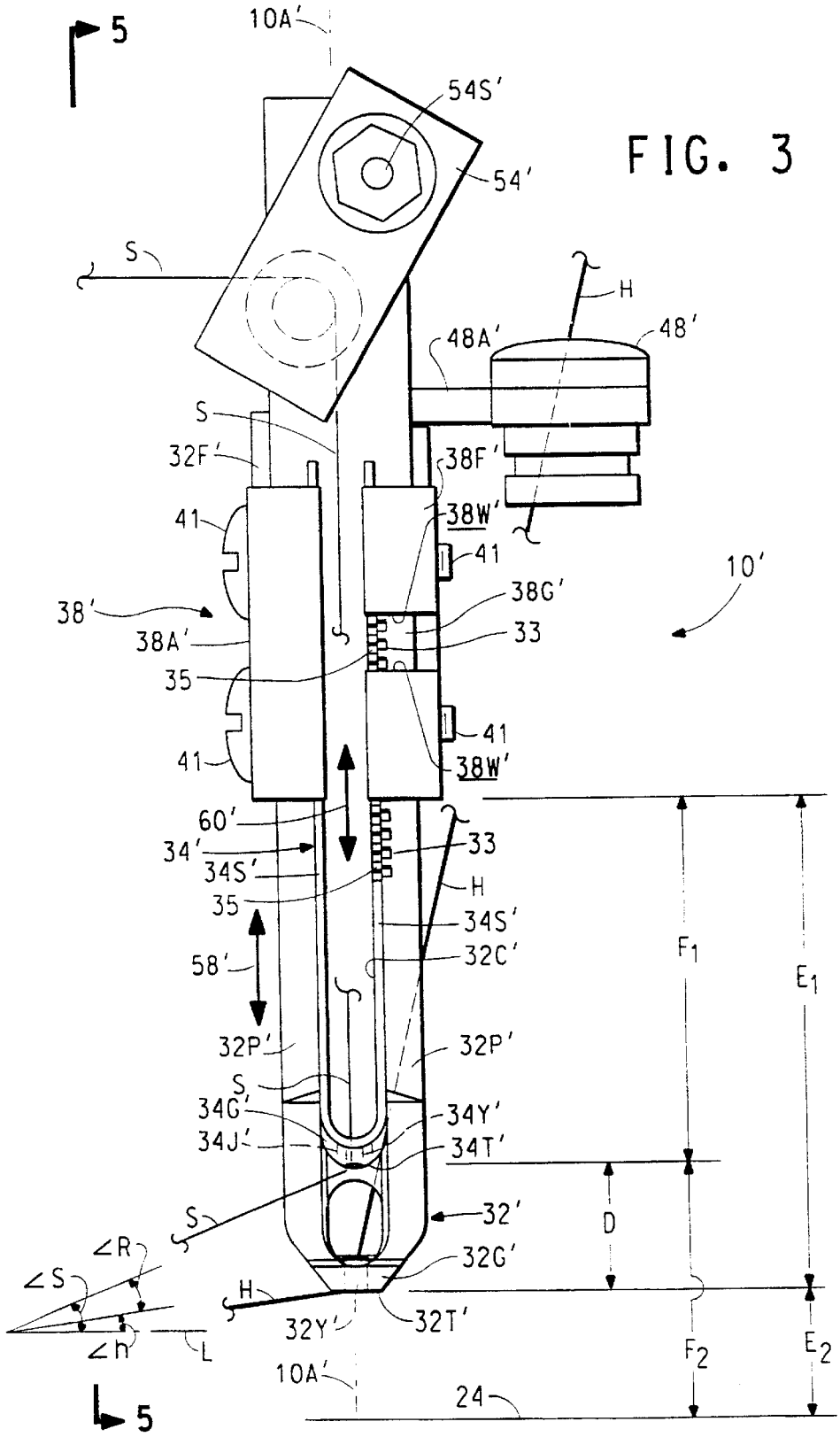
FIG. 3 is a front elevational view of a yarn carrier for a knitting apparatus in accordance with a second embodiment of this invention.

In the yarn carrier 10' shown in FIGS. 3 through 7, the bracket 38' includes a generally C-shaped clamp member 38C' having a base 38B' from which extend a pair of clamping arms 38A'. The ends of each clamping arm 38A' are bent toward each other to define holding flanges 38F'. As is best seen in FIG. 3 one of the arms 38A' has an access gap 38G' therein. The gap 38G' defines working surfaces 38W' for a purpose to be described. The base 38B' of the clamp 38C' is welded or otherwise conveniently secured (as indicated by the stipled area at 37', FIG. 5) to one end of a generally L-shaped holder 38L'. The second end of the holder 38L' has an elongated slot 38S' therein. A bolt 40' passing through the slot 38S' in the second end of the holder 38L' adjustably secures to the bracket 38' to the traversing mechanism T of the knitting apparatus.

The yarn guide 32' for the hard yarn H is modified from the structure shown in FIGS. 1 and 2. In the embodiment of FIGS. 3 through 6 the yarn guide 32' includes a pair of panels 32P' that extend upwardly from the elongated flange portion 32F'. The panels 32P' and the surface of the flange portion 32F' cooperate to define a channel 32C' that extends axially over a portion of the yarn guide 32'. The upper edge of one of the panels 32P' has an array of spaced teeth 33 therein, for a purpose to be described.

The yarn guide 34' for the soft yarn S is also modified from the corresponding structure shown in FIGS. 1 and 2. In the embodiment of FIGS. 3 through 6 the yarn guide 34' a slotted, generally tubular member that is slidably received, telescopic fashion, within the channel 32C' formed in the yarn guide 32'. As viewed in the drawings, the lower end of the yarn guide 34' having the jewel 34J' therein extends axially beyond the panels 32P' on the guide 32'. The sidewalls 34S' of the yarn guide 34' extend above the edges of the yarn guide 32'. The upper edge of the sidewall 34S' closer to the teeth 33 on the guide 32' also has an array of spaced teeth 35 provided therein. The spaces between the teeth 35 in the guide 34' are larger than the corresponding spaces between the spaces between the teeth 33 in the guide 32'. This discrepancy in tooth spacing results in the teeth in the guides being offset from each other, for a purpose that becomes clearer herein.

To assemble the carrier 10', the yarn guide 32', having the yarn guide 34' nested therein, extends slidably and telescopically through the bracket 38'. As seen in from FIG. 5 a spring 39 is captured between the holder 38L' of the bracket 38' and the undersurface of the flange portion 32F' of the yarn guide 32'. The force of the spring 39 acts through the yarn guide 32' to bias the upper edges of the sidewalls 34S' on the yarn guide 34' against the holding flanges 38F' on the clamping arms 38A'. Threaded screws 41 act to draw together the arms 38A' of the clamp 38C' thereby to secure the yarn guide members 32', 34' in the described relationship within the bracket 38'. The heads of the screws 41 are located to the side of the bracket 38' away from the path of the hard yarn H.

Figure 4:
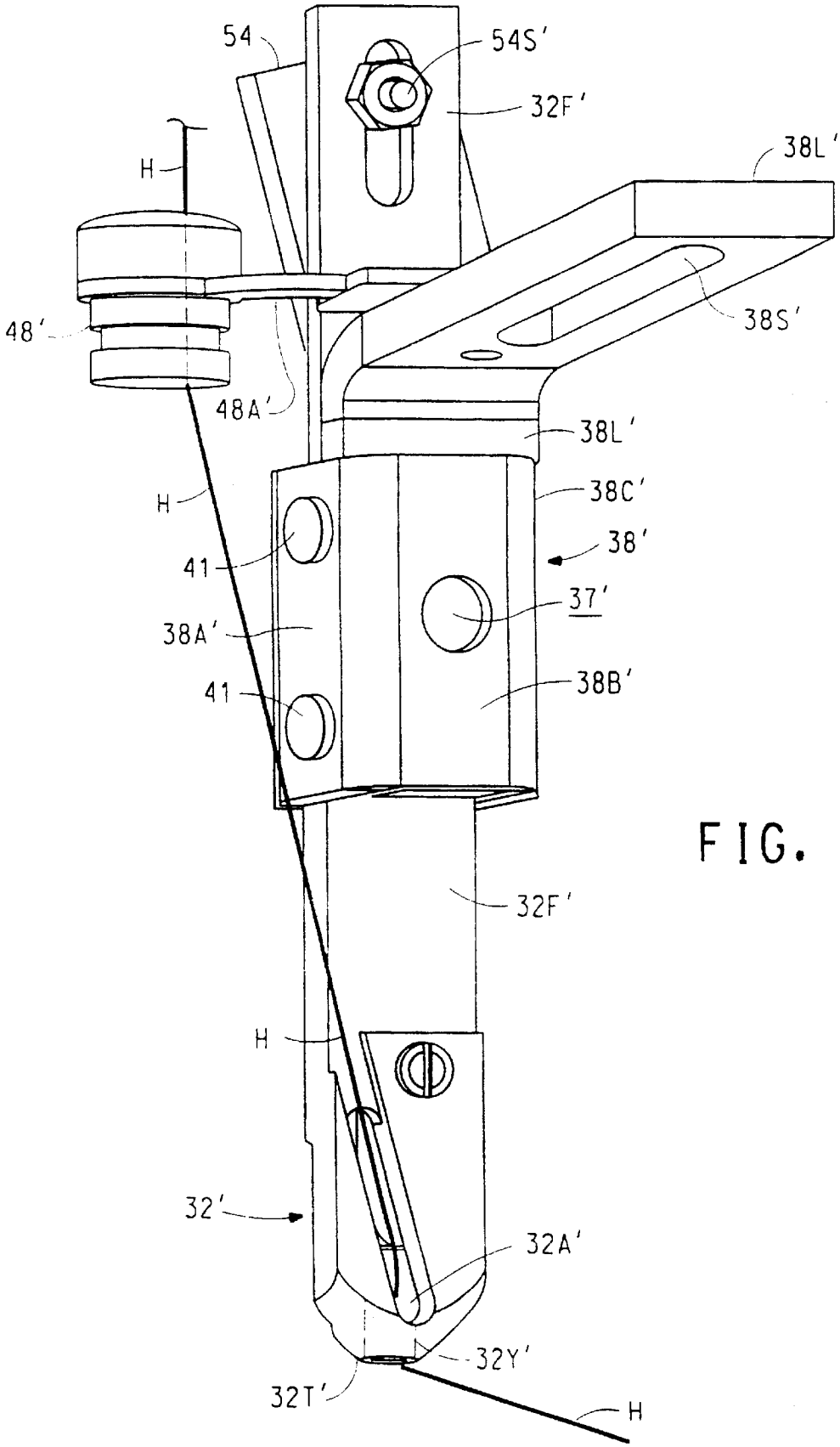
FIG. 4 is a rear perspective view of the yarn carrier of FIG. 3.

Each plating yarn is supplied to its yarn guide in a manner generally similar to that described in connection with FIGS. 1 and 2. The hard yarn H is supplied to the tip of the yarn guide 32' through the grommet 48'. The yarn H enters the guide portion of the guide member 32' through the access opening 32A' located on the rear surface of the first yarn guide 32' (FIG. 4). The yarn H passes through the passage 32Y' in the tip 32T' and is deflected toward the needle N. The soft yarn S (FIG. 3) is directed over the pulley 52' and passes through the central channel of the yarn guide 34' toward the tip 34T'. As the soft yarn S exits the passage 34Y in the jewel 34J' in the tip 34T' it is deflected toward the needle N.

The angles ∠h, ∠s is defined by the respective hard and soft yarns respect to the datum line L and the relative angle ∠R defined between the hard yarn H and the soft yarn S are as described in connection with FIGS. 1 and 2.

The angle ∠R is adjusted by varying the distance D extant between the yarn exit points at the ends of the passages 32Y', 34Y' in the tips 32T', 34T' on the respective yarn guides 32', 34'. First, the clamping force imposed by the threaded screws 41 is released. The guides 32', 34' are prevented from dropping from the bracket 38' by the holding force imposed by the bias spring 39. Once the clamping force is released the guide member 32' may moved with respect to the guide 34' in the direction of the arrows 58' to vary the distance D. Again, the direction of the motion of the guide 32' is generally parallel to the axis 10A' of the joined yarn guides. The guide 32' is rectilinearly moved with respect to the guide 34' by inserting a levering implement, such as a flat blade driver, into the spaces between the offset teeth 33, 35 provided on the guides 32', 34', respectively. The levering action of the implement against a tooth 33 on the guide 32' (using a tooth 35 on the guide 34' as a fulcrum) displaces the guide 32' with respect to the guide 34'. It lies within the contemplation of this invention to alter the structure of the carrier 10' to permit other than rectilinear motion between the guides 32', 34' to alter the distance D and the angle ∠R.

To alter the angles ∠h and ∠s, without adjusting the distance D the guide member 32' may be moved with respect to the bracket 38' in the direction of the arrows 60'. Once the clamping force is released the implement may be inserted into a space between the teeth 33 on the guide 32' that are accessible through the gap 38G' in the arm 38A' of the bracket 38'. The levering action of the implement against the working surfaces 38W' causes the guide member 34' to displace with respect to bracket 38'. It is noted that guides 32', 34' may be moved in one direction by levering the implement against the bottom edge of the lower arm 38A'. However, relative movement of the guides 32', 34' in the opposite direction would not be possible without the presence of the working surface 38W' on the upper edge of the lower arm 38A'.

As noted earlier, the embodiment of the invention shown in FIGS. 3 through 6 includes structure that permits a further adjustment in the feeding the yarns to the knitting needle(s) N. In general, the first and second guide members 32', 34' are also relatively movable with respect to each other in a second direction indicated by the arrows 68A, 68B to move the yarn exit point at the end of the passage in the tip of one of the yarn guides toward or away from the reference plane 28. As will be developed this action adjusts the relative position on a needle occupied by the first and second yarns.

The actuating mechanism to effect this relative movement of the yarn guides in the second directions 68A, 68B includes a threaded thumbscrew 62, having an enlarged head 62H, that extends through the lower end of the first guide 32'. The end 62E of the thumbscrew 62 engages the rear surface of the flange 34F' of the first guide 34'. Manipulation of the head 62H advances the end 62E of the thumbscrew 62 in the direction of the arrow 67.

Advancement of the thumbscrew 62 exerts a force on the lower end of the guide 34' to cause it to deflect relative to the guide 32' against the bias of the spring 39 in a direction 68A. The direction 68A is generally perpendicular to the plane containing the directions 58', 60'. In addition, the other guide 32' also relatively moves with respect to the guide 34' in the counter direction 68B, also generally perpendicular to the plane containing the directions 58', 60'. When the thumbscrew 62 is retracted the restored force generated by the spring 39 returns the guides 32', 34' to their original positions relative to each other.

The imposition of a deflecting force on the lower end of the guide 34' moves it relative to the first guide 32'. This displaces the yarn exit point at the end of the passage 34Y' in the tip 34T' of the guide 34' toward or away from the bisecting reference plane 28. As a result the relative position of the yarns H, S in the hook of the needle N may be changed. In the instance illustrated in FIGS. 7A and 7B, the soft yarn S may relocate from an initial position in which the yarns are abutting or relatively close to each other to a second position in which the yarns are relatively distant from each other.

Figure 7A:
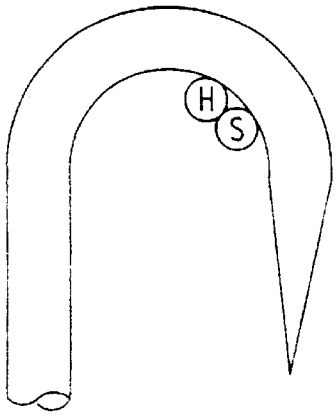
FIGS. 7A through 7D are stylized diagrammatic views illustrating the relative positions of hard and soft yarns in the hook of a needle.
Figure 7B:
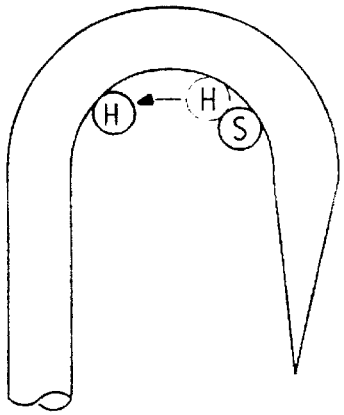
Figure 7C:
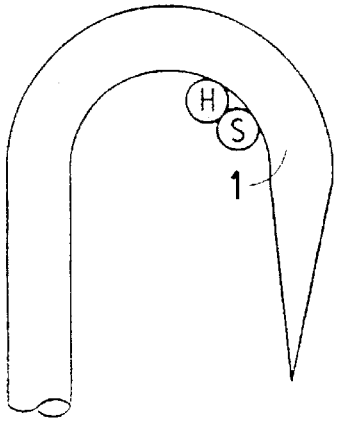
Figure 7D:
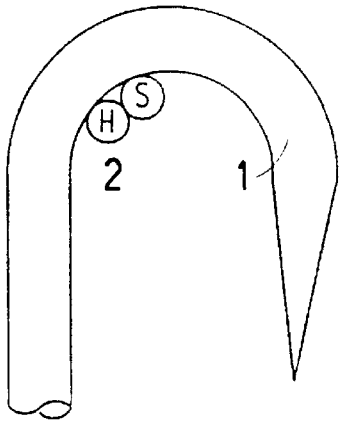

Once the yarns S, H are adjusted with respect to each other by virtue of the movement of the guides 32', 34' in the directions 68A, 68B, the location of the yarns H, S with respect to the hook of the needle N may be adjusted by movement of the entire carrier 10' with respect to the traversing mechanism T. Thus, as suggested in FIGS. 7C and 7D, once the yarns H, S are positioned have been positioned as desired with respect to each other by the action of the thumbscrew 62 (FIG. 7C) the screw 40' be loosened and the entire carrier 10' may be relocated on the traversing mechanism T in the directions 72. This latter relocation has the effect of adjusting the location of the relatively positioned yarns from an initial point "1" on the hook of the needle N (FIG. 7C) to a second point "2" on the hook of the needle N (FIG. 7D)

This ability to adjust the plating yarn S with respect to the hard yarn H within the hook of the needle is advantageous when rib stitching is necessary, as, for example, when knitting wrist bands and waist bands of a knitted garment.

Figure 5:
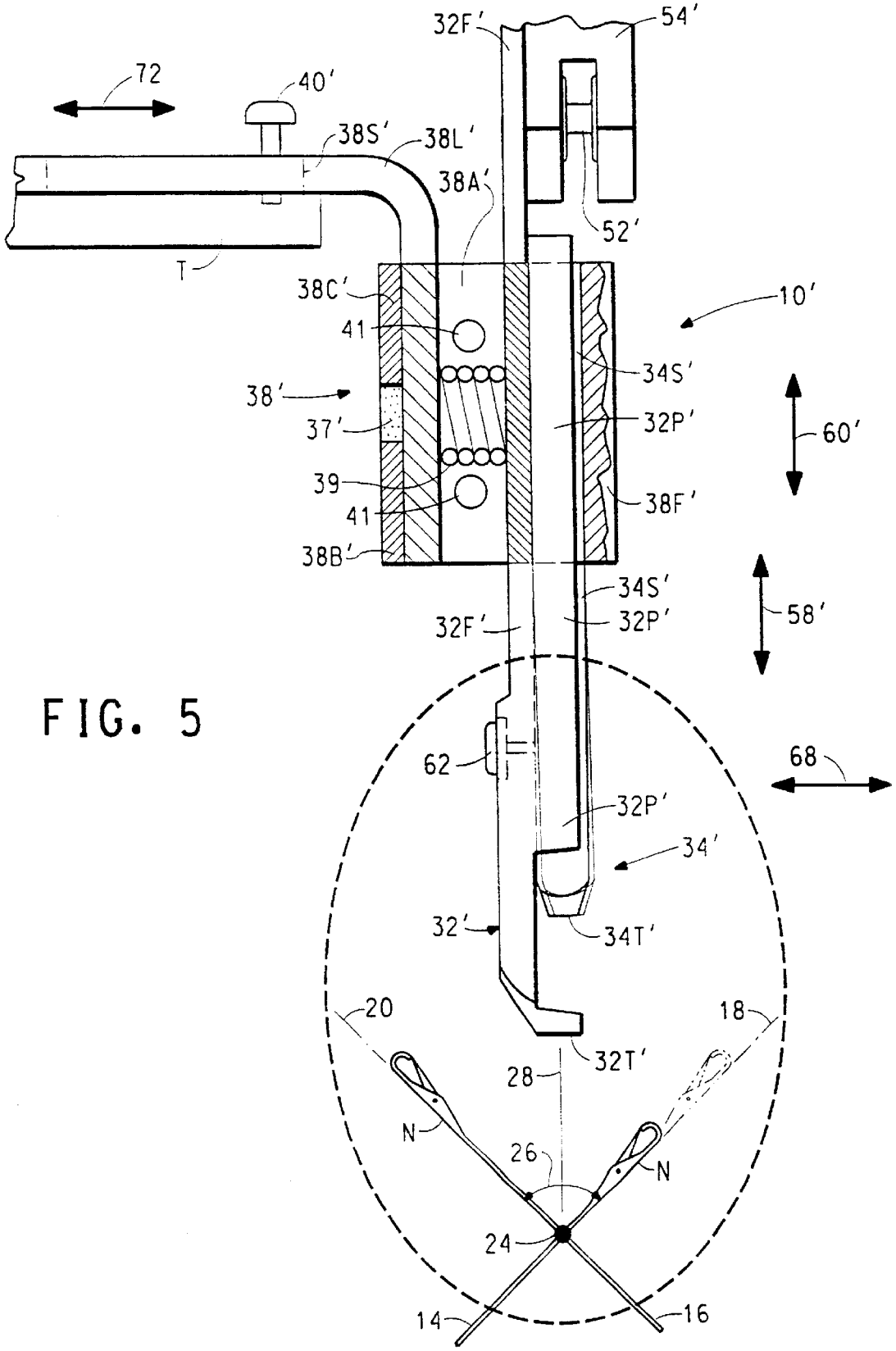
FIG. 5 is a side elevational view, partially in section, of the yarn carrier of FIG. 3 generally taken along view lines 5—5 therein.
Figure 6:
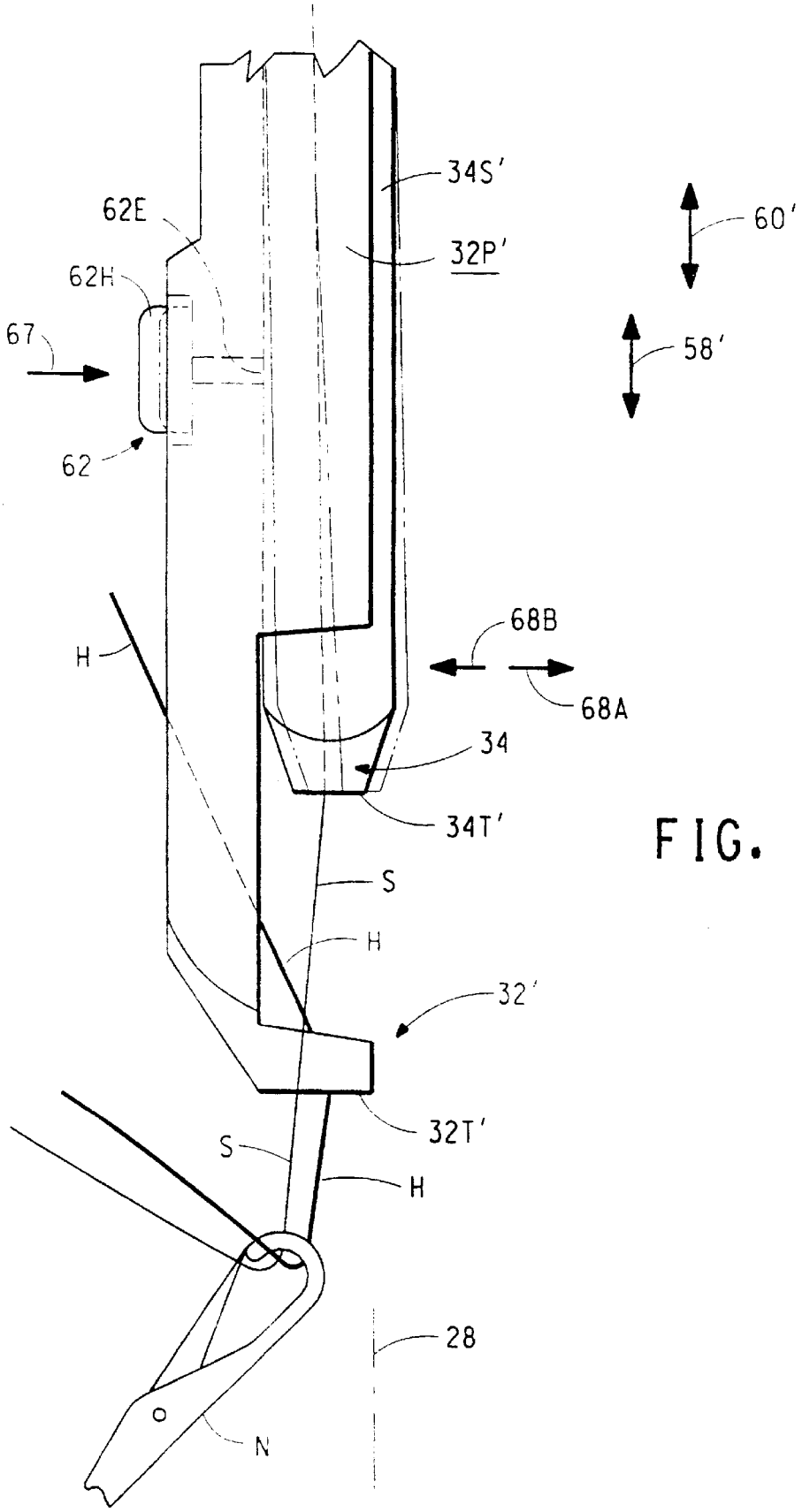
FIG. 6 is an enlarged view of a portion of FIG. 5.

It should be noted that in FIGS. 5 and 6 the tip 34T' of the guide 34' displaces along an arcuate path as it moves in the direction of the arrows 68 toward or away from the plane 28. However, it lies within the contemplation of this invention to modify the structure of the carrier 10' such that the tip 34' may move along a rectilinear, curvilinear or rotational path. Any convenient mechanism that displaces the tip 34T' of the guide 34' along any given path toward or away from the reference plane 28 may be used.

The carriers 10, 10' as described herein may be fabricated from any suitable material having sufficient strength to undergo sustained usage in the environment of a high speed knitting apparatus. However, the mass of the carrier must also be considered in the selection of materials. Steel is the material of choice for the embodiment of FIGS. 3 through 6.

-o-0-o-

Figure 8A:
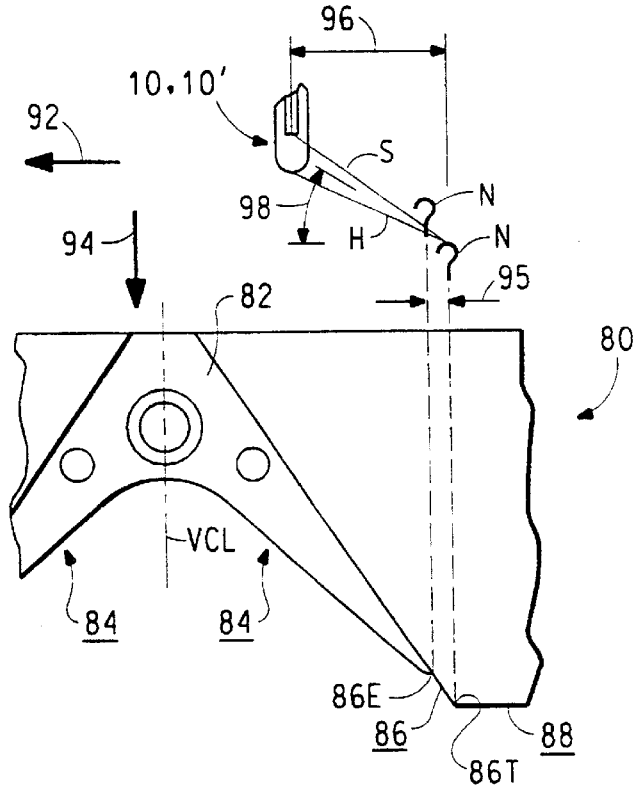
FIG. 8A (PRIOR ART)
FIGS. 8A and 8B are, respectively, a prior art cam plate and a modified cam plate found particularly useful with the yarn carrier of the present invention.
Figure 8B:
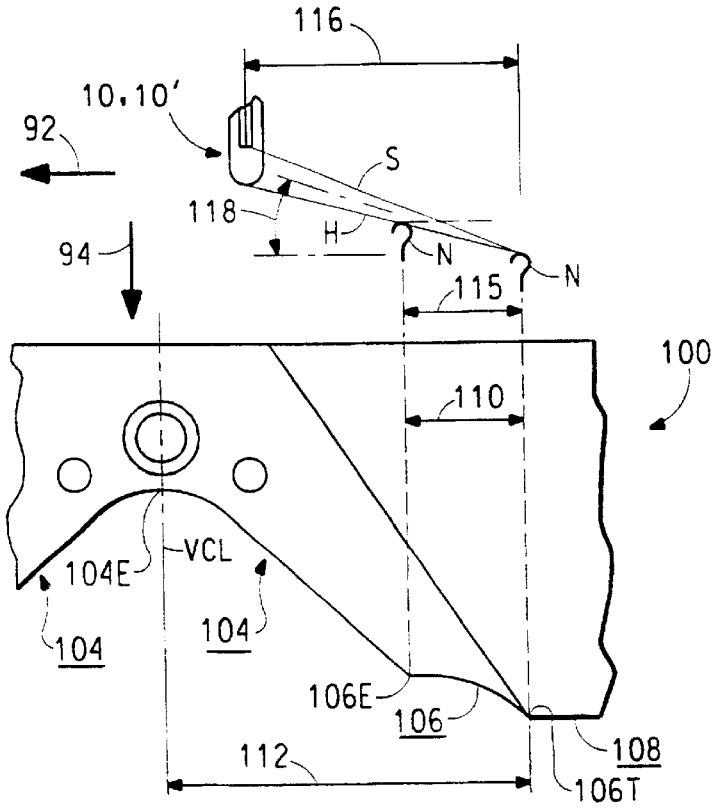

FIGS. 8A and 8B stylistically illustrate, respectively, portions of a prior art cam plate and a modified cam plate found particularly useful with the yarn carrier 10, 10' of the present invention.

The cam plate 80 of the prior art includes a guard cam 82 having a needle return surface 84. Two surfaces 84 are symmetrically disposed with respect to the vertical centerline VCL of the cam 82 to permit reciprocating knitting action, as is appreciated by those skilled in the art. The needle return includes a transition portion 86 leading, at an end point 86T, to a stitch cam surface 88. As illustrated, the slope of the needle return surface 84 abruptly changes at the entry point 86E of the transition region 86.

In operation, assuming that the cam plate 80 and a yarn carrier 10, 10' are traversing the knitting apparatus in the direction of the arrow 92, as the butt of a needle rides along the major length of the needle return surface 84 each needle N retracts in its needle plane in the downward direction 94. As a needle N encounters the entry point 86E on the cam the hook of the needle N is positioned slightly above the plating yarns H, S. By the time the needle N reaches the end point 86T of the transition region 86 the plating yarns H, S have been picked up in the needle hook. Owing to the relatively steep slope of the surface of the transition region 86, the cam plate transverses a relatively short linear distance 95 during the yarn pick-up operation. At the time of yarn pick-up the carrier 10, 10' is spaced a transverse distance 96 from the needle N. At this distance the yarns define a relatively steep entry angle 98 with respect to the needle N. In some instances, even though the angle ∠R between the yarns H, S has been appropriately adjusted by the operation of the carrier 10, 10', the steepness of the entry angle 98 may prevent pick-up of the soft yarn.

FIG. 8B illustrates a portion of a cam plate 100 that is believed to overcome problems associated with steep entry angle and is thus believed to be especially useful with the carrier 10, 10' of the present invention. As in the prior art the cam plate 100 includes needle return surfaces 104 that are symmetrically disposed with respect to the vertical centerline VCL of the cam 100. The needle return surface has a beginning point 104E that usually lies on the vertical centerline VCL. The end of the needle return surface 104 includes a transition region 106 that extends between points 106E, 106T. In the cam 100 illustrated in FIG. 8B the transition region 106 of the needle return surface 104 gently slopes toward the stitch cam surface 108. The transition surface 106 may be gently linearly sloped or gently arced.

In practice, with a cam plate 100 the linear distance 110 of the transition portion 106 (as measured in the direction of motion 92 of the cam 100 between the entry and end points 106E, 106T) is in the range from fifteen to forty five percent (15% to 45%) of the linear distance 112 between the beginning point 104E of the needle return surface 104 (in FIG. 8B, the vertical centerline VCL,) and the point 106T (as measured in the same direction), depending upon the gauge of the knitting apparatus. More particularly, the linear distance 110 is in the range from thirty to forty five percent (30% to 45%) of the linear distance 112, depending upon the gauge of the knitting apparatus.

In operation, it is again assumed that the cam plate 100 and a yarn carrier 10, 10' are traversing the knitting apparatus in the direction of the arrow 92. When the needle N encounters the entry point 106E on the cam 100 the eye of the needle N is positioned slightly above the plating yarns H, S, at the point 114. As the needle N reaches the end point 106T of the transition region 106 the plating yarns H, S have been picked up in the needle hook. However, owing to the gentle slope of transition region 106, the needle dwells at the level of the point 114, so that at the time of yarn pick-up the cam plate 100 may transverses a relatively greater linear distance 115 than is possible with a cam of the prior art. Thus, at the time of yarn pick-up, the carrier 10, 10' is spaced a relatively greater transverse distance 116 from the needle N. At this distance 116 the yarns H, S define a relatively shallower entry angle 118 with respect to the needle N.

From the foregoing it may be appreciated that the yarn carrier in accordance with either embodiment of the present invention permits adjustments of the angles of the yarns as they exit the yarn carrier toward the knitting needles. As such, the ability of the needles to capture the yarns is believed enhanced, despite factors such as whether the knitting apparatus is a hand knitting or electronic machine, the gauge of the machine, yarn denier, fabric construction, needle hook size or shape, and stitch density.

Those skilled in the art, having the benefit of the teachings of the present invention as hereinbefore set forth, may effect modifications thereto. Any such modifications are to be encompassed within the scope of the present invention, as defined by the appended claims.

What is claimed is:

1. A carrier for conveying a first and a second plating yarn to a needle with an angle being defined between the plating yarns, the carrier comprising:

a first guide member and a second guide member, each guide member having a yarn dispensing passage from the ends of which a plating yarn is able to be guided toward a needle, the first guide member being mounted to the second guide member;

the first guide member and the second guide member being relatively movable with respect to each other in a first direction to adjust the spacing between the ends of the passages and thereby to adjust the angle between the plating yarns.

2. The yarn carrier of claim 1 wherein the one of the first and second guide members is slidably and telescopically received within the other guide member.

3. The yarn carrier of claim 2 wherein the first and second guide members each carry an array of spaced teeth thereon, the spacing between the teeth being sized to receive a levering implement to move one guide member with respect to the other.

4. The yarn carrier of claim 1 further comprising:

a bracket;

one of the first and second guide members being fixed to the bracket, the other of the first and the second guide members being movable in the first direction with respect to the fixed guide member.

5. The yarn carrier of claim 1 further comprising:

a bracket;

one of the first and second guide members being movably connected to the bracket, the other of the first and the second guide members being movable in the first direction with respect to the guide member that is movably connected to the bracket.

6. The yarn carrier of claim 1 wherein one of the first guide member and the second guide members is also relatively movable with respect to the other in a second direction, thereby to adjust the relative position on the needle occupied by the first and second yarns.

7. The yarn carrier of claim 6 wherein the other yarn carrier includes an actuating screw member that engages the relatively movable member, advancement of the actuating screw member moving the movable member in the second direction.

8. The yarn carrier of claim 4 wherein one of the first guide member and the second guide members is also relatively movable with respect to the other in a second direction, thereby to adjust the relative position on the needle occupied by the first and second yarns.

9. The yarn carrier of claim 8 wherein the other yarn carrier includes an actuating screw member that engages the relatively movable member, advancement of the actuating screw member moving the movable member in the second direction.

10. The yarn carrier of claim 5 wherein one of the first guide member and the second guide members is also relatively movable with respect to the other in a second direction, thereby to adjust the relative position on the needle occupied by the first and second yarns.

11. The yarn carrier of claim 10 wherein the other yarn carrier includes an actuating screw member that engages the relatively movable member, advancement of the actuating screw member moving the movable member in the second direction.

12. The yarn carrier of claim 1 wherein the carrier has a longitudinal reference axis extending there through, and wherein the first direction is generally parallel to the longitudinal reference axis.

13. The carrier assembly of claim 12 wherein one of the first guide member and the second guide members is also relatively movable with respect to the other in a second direction generally transverse to the longitudinal reference axis, thereby to adjust the relative position on the needle occupied by the first and second yarns.

14. A carrier for conveying a first and a second plating yarn to a needle with an angle being defined between the plating yarns, the carrier comprising:

a bracket;

a first and a second guide member, each guide member having a yarn dispensing passage from the ends of which a yarn is able to be guided toward a needle;

wherein one of the first or the second guide members is movably mounted to the bracket while the other of the guide members is mounted to the movably mounted guide member, the one guide member being movable in a first direction with respect to the bracket to adjust the spacing between the end of the passage on the movable guide member and the bracket, thereby to adjust the angle between the plating yarns.

15. The carrier assembly of claim 14 wherein one of the first guide member and the second guide members is also relatively movable with respect to the other in a second direction, thereby to adjust the relative position on the needle occupied by the first and second yarns.

16. The yarn carrier of claim 15 wherein the other yarn carrier includes an actuating screw member that engages the relatively movable member, advancement of the actuating screw member moving the movable member in the second direction.

17. The yarn carrier of claim 15 wherein the one of the first and second guide members is slidably received within the bracket.

18. The yarn carrier of claim 17 wherein the one of first and second guide members carries an array of spaced teeth thereon, the spacing between the teeth being sized to receive a levering implement to move the one guide member with respect to the bracket.

19. In a knitting apparatus having a first and a second array of needles, each needle in the first array being extendable and retractable in a first plane, each needle in the second array being extendable and retractable in a second plane, the first and the second planes intersecting to define a intersection line extending transversely across the knitting apparatus, the knitting apparatus having a carrier assembly for conveying a first and a second plating yarn to each of the needles with a angle being defined between the plating yarns, the carrier comprising:

a first guide member and a second guide member, each guide member having a yarn dispensing passage from the ends of which a yarn is able to be guided toward a needle, one of the guide members being mounted to the other guide member;

wherein the improvement comprises:

the first guide member and the second guide member being relatively movable with respect to each other in a first direction to adjust the spacing between the ends of the passages as measured in a direction perpendicular to the line of intersection and thereby to adjust the angle between the plating yarns.

20. The knitting apparatus of claim 19 wherein the one of the first and second guide members is slidably and telescopically received within the other guide member.

21. The knitting apparatus of claim 20 wherein the first and second guide members each carry an array of spaced teeth thereon, the spacing between the teeth being sized to receive a levering implement to move one guide member with respect to the other.

22. The knitting apparatus of claim 19 further comprising:

a traversing mechanism;

a bracket for connecting the yarn carrier to the traversing mechanism;

one of the first and second guide members being fixed to the bracket, the other of the first and the second guide members being movably mounted with respect to the fixed guide member.

23. The knitting apparatus of claim 19 further comprising:

a traversing mechanism;

a bracket for connecting the yarn carrier to the traversing mechanism;

one of the first and second guide members being movably connected to the bracket, the other of the first and the second guide members being movable in the first direction with respect to the guide member that is movably connected to the bracket.

24. The knitting apparatus of claim 19 wherein the first and the second needle planes define an angle therebetween, a reference plane extending between the needle planes being defined on the knitting apparatus, the reference plane including the transversely extending intersection line, wherein the improvement further comprises:

one of the first guide member and the second guide members is also relatively movable with respect to the other in a second direction to move the passage on the movable guide member toward or away from the reference plane thereby to adjust the relative position on the needle occupied by the first and second yarns.

25. The knitting apparatus of claim 24 wherein the other yarn carrier includes an actuating screw member that engages the relatively movable member, advancement of the actuating screw member moving the movable member in the second direction.

26. The knitting apparatus of claim 22 wherein the first and the second needle planes define an angle therebetween, a reference plane extending between the needle planes being defined on the knitting apparatus, the reference plane including the transversely extending intersection line, wherein the improvement further comprises:

one of the first guide member and the second guide members is also relatively movable with respect to the other in a second direction to move the passage on the movable guide member toward or away from the reference plane thereby to adjust the relative position on the needle occupied by the first and second yarns.

27. The knitting apparatus of claim 26 wherein the other yarn carrier includes an actuating screw member that engages the relatively movable member, advancement of the actuating screw member moving the movable member in the second direction.

28. The knitting apparatus of claim 23 wherein the first and the second needle planes define an angle therebetween, a reference plane extending between the needle planes being defined on the knitting apparatus, the reference plane including the transversely extending intersection line, wherein the improvement further comprises:

one of the first guide member and the second guide members is also relatively movable with respect to the other in a second direction to move the passage on the movable guide member toward or away from the reference plane thereby to adjust the relative position on the needle occupied by the first and second yarns.

29. The knitting apparatus of claim 28 wherein the other yarn carrier includes an actuating screw member that engages the relatively movable member, advancement of the actuating screw member moving the movable member in the second direction.

30. The knitting apparatus of claim 19 wherein the carrier has a longitudinal reference axis extending therethrough, and wherein the first direction is generally parallel to the longitudinal reference axis.

31. The knitting apparatus of claim 19 further comprising a cam plate having a needle return surface with a beginning point thereon, the needle return surface including a transition region that extends between an entry point and an end point, the ratio of (i) the linear distance between the entry point and an end point of the transition region and (ii) the linear distance between the beginning point of the needle return surface and the end point of the transition surface being in the range from fifteen to forty five percent (15% to 45%).

32. The knitting apparatus of claim 30 wherein the first and the second needle planes define an angle therebetween, a reference plane extending between the needle planes being defined on the knitting apparatus, the reference plane including the transversely extending intersection line, wherein the improvement further comprises:

wherein one of the first guide member and the second guide members is also relatively movable with respect to the other in a second direction generally transverse to the longitudinal reference axis to move the passage on the movable guide member toward or away from the reference plane thereby to adjust the relative position on the needle occupied by the first and second yarns.

33. In a knitting apparatus having a first and a second array of needles, each needle in the first array being extendable and retractable in a first plane, each needle in the second array being extendable and retractable in a second plane, the first and the second planes intersecting to define a intersection line extending transversely across the knitting apparatus, the knitting apparatus having a bracket;

a carrier assembly for conveying a first and a second plating yarn to each of the needles with an angle being defined between the plating yarns, the carrier comprising:

a first guide member and a second guide member, each guide member having a yarn dispensing passage from the ends of which a yarn is able to be guided toward a needle;

wherein the improvement comprises:

one of the first or the second guide members is movably mounted to the bracket while the other of the guide members is mounted to the movably mounted guide member, the one guide member being movable in a first direction with respect to the bracket to adjust the spacing between the ends of the passage on the movable guide member and the bracket as measured in a direction perpendicular to the line of intersection, thereby to adjust the angle between the plating yarns.

* * * * *